US006165294A

United States Patent [19]

Fogelzang et al.

[11] Patent Number: 6,165,294

[45] **Date of Patent: *Dec. 26, 2000**

[54] PYROTECHNICAL PERCUSSION COMBUSTION COMPOSITION FOR SMALL ARMS AMMUNITION PRIMERS

[76] Inventors: Alexander Evgenievich Fogelzang, Krasnij Majak Str. 1/1-154, 113518, Moscow; Vladimir Petrovich Korolev, Klimovsk-1, Molodezhnaya Str., 2/2-9, 142080, Moscow Region; Vyacheslav Yurjevich Egorshev, Zarajskaya Str., 27-63, 109428, Moscow; Vasilij Ivanovich Kolesov, Timiryazevskaya Str., 15-76, 123455, Moscow; Valerij Dmitrievich Pochukaev, Simpheropolskaya Str 17-45, Kimovsk city, 42080 Moscow Region; Yurij Matveevich Baskakov, Komsomolskaya Str.3, Kimovsk city, 42080 Moscow Region; Alexander Sergeevich Tokarev, Zavodskaja Str, 24/47, Klimovsk city, 42080 Moscow Region; Nikolaj Michajlovich Bibnev, Muromskaja Str., 3-59, Murom city, 602200, Vladimir Region; Vladimir Nikolaevich Hovanskov, 30 Ljet Pobadi, 3-15, 60220, Vladimir Region, Murom city; Irina Fedorovna Evdokimova, Zavodskaja str, 11/2-10, 142080, Klimovsk city, Moscow Region; Yurij Pavlovich Voronin, Michurina Str., 8-42, 142090, Klimovsk city, Moscow Region, all of Russian Federation

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,895

[22] Filed: Mar. 16, 1998

[30] Foreign Application Priority Data

Mar. 18, 1997 [RU] Russian Federation ..... 97-10.3612.02

[51] Int. Cl.[7] ..... C06B 41/00; C06B 25/34; C06B 25/04

[52] U.S. Cl. ..... 149/23; 149/92; 149/105

[58] Field of Search ..... 149/23, 105, 106, 149/2, 92; 102/202.5

[56] References Cited

U.S. PATENT DOCUMENTS

| | | | |
|---|---|---|---|
| 4,402,268 | 9/1983 | Usel et al. | 102/202.5 |
| 4,608,102 | 8/1986 | Krampen et al. | 149/92 |
| 4,675,059 | 6/1987 | Mei | 149/43 |
| 4,963,201 | 10/1990 | Bjerke et al. | 149/2 |
| 5,167,736 | 12/1992 | Mei et al. | 149/22 |
| 5,216,199 | 6/1993 | Bjerke et al. | 102/471 |
| 5,466,315 | 11/1995 | Erickson et al. | 149/96 |
| 5,547,528 | 8/1996 | Erickson et al. | 149/92 |
| 5,567,252 | 10/1996 | Mei et al. | 149/22 |

OTHER PUBLICATIONS

Explosives, Rudolph Meyer, 262–263, 1977.

*Primary Examiner*—Charles T. Jordan
*Assistant Examiner*—Aileen J. Baker
*Attorney, Agent, or Firm*—Mark E. Ogram P.C.

[57] ABSTRACT

A universal pyrotechnical percussion compositions used in rimfire ammunition and in cenerfire ammunition primers which is free of lead and other heavy metals. In the PCC of the present invention, the task of maintaining ecological purity of its burning products, absence of corrosion action on a barrel, increased shelf-life, with simultaneous increase of energetic parameters of primer and ballistic characteristics of a shot is achieved. The composition includes a base mixture of diazodinitrophenol, tetrazene and an inert organic or glass stablizer. To this base mixture, monopotassium styphnate or potassium dinitrobenzofuroxane is added. The mixture so created has a specific gravity of less than 1.7 grams per cubic centimeter.

4 Claims, 6 Drawing Sheets

| PRIMER | WEIGHT OF PCC, MGRAMM. | TYPE OF POWDER | POWDER CHARGE WEIGHT, GRAMMS | BULLET VELOCITY $V_{10}$ MED, M/SEC. | BULLET VELOCITY DISORDER, $D_{V10}$, M/C | MAX. POWDER GASES PRESSURE, $P_{MAXMED}$ KG/CM² | $D_{PMAX}$ KG/CM² |
|---|---|---|---|---|---|---|---|
| KV26 | 22 | P-125 29/91 T | 0,24 | 295 | 8 | 910 | 45 |
| KV26-OP (NEW) | 12 | P-125 29/91 T | 0,24 | 304 | 9 | 1024 | 67 |
| REQUIREMENTS (DRAWING 4-27147) | 20..... .... 24 | P-125 | 0,20- - 0,26 | 290- 315 | < 30 | < 1200 | - |

| PRIMER | WEIGHT OF PCC, MGRAMM. | TYPE OF POWDER | POWDER CHARGE WEIGHT, GRAMMS | BULLET VELOCITY $V_{10}$ MED, M/SEC. | BULLET VELOCITY DISORDER, $D_{V10}$, M/C | MAX. POWDER GASES PRESSURE, $P_{MAXMED}$ KG/CM$^2$ | $D_{PMAX}$ KG/CM$^2$ |
|---|---|---|---|---|---|---|---|
| KV26 | 22 | P-125 29/91 T | 0,24 | 295 | 8 | 910 | 45 |
| KV26-OP (NEW) | 12 | P-125 29/91 T | 0,24 | 304 | 9 | 1024 | 67 |
| REQUIREMENTS (DRAWING 4-27147) | 20..... .... 24 | P-125 | 0,20-- 0,26 | 290-- 315 | < 30 | < 1200 | – |

TABLE 1A

| PCC | BURNING PRODUCTS, CONTENT, MOL x KG$^{-1}$ | | | QUANTITY OF K-PHASE % | CONTENT OF K-PHASE | BURNING TEMP. T°K | PCC ENERGY KJOULS /KG | SPECIFIC GRAVITY OF PCC, GR/CM$^3$ |
|---|---|---|---|---|---|---|---|---|
| | $H_2$ | $N_2$ | CO | | | | | |
| NEW | 4,4 | 7,9 | 20,2 | 16,6 | KC, $KSiO_2$ | 2337 | 653 | 1,66 |
| PROTOTYPE | 3,4 | 6,5 | 12,0 | 44,3 | MnO, $SiO_2$ | 1953 | 373,6 | 2,20 |

TABLE 2A

| PRIMER | CONTENT OF COMPONENTS (IN MASS %) | | | | | PCC ENERGY | BURNING TEMP. | BURNING PROD. CONTENT, MOL/KG | | | | | |
|---|---|---|---|---|---|---|---|---|---|---|---|---|---|
| | DIAZOD 1-NITRO PHENOL | POTASIUM AZIDO DINITRO-PHENOL | POTASSIUM DINITRO-BENZO-FUROX-ANE | TETRA-CENE | INERT SENSI-BILI-ZATOR | KJOULS/KG | °K | $H_2$ | $N_2$ | CO | SOLID PHASE | | |
| | | | | | | | | | | | #1 | #2 | K |
| PROTO-TYPE | 50 | 20 | - | 5 | 20 | 416 | 1695 | 3,7 | 6,5 | 15,9 | 3 | 4 | 1,5 |
| NEW | 45 | - | 30 | 6 | 19 | 472 | 1908 | 4,5 | 7,4 | 16,9 | 2 | 4 | 1 |

#1 - "KC"
#2 - "$KSiO_2$"

TABLE 1B

| PCC | WEIGHT OF PCC, MGRAMM | POWDER CHARGE WEIGHT, MGRAMM | $V_{10}$ MED, M/SEC | $D_{V10}$, M/SEC | $P_M$ MED, KG/CM$^2$ | $D_P$ MAX, KG/CM$^2$ |
|---|---|---|---|---|---|---|
| NEW | 11 | 0,090 | 318 | 4 | 906 | 37 |
| PROTOTYPE | 14 | 0,094 | 312 | 8 | 937 | 101 |
| REQUIRE-MENTS OF TECHNICAL CONDITIONS FOR "OLIMP" | 22 | 0,080-0,099 | 315 ± 5 | <5..7 | 900 ± 50 | <100 |

TABLE 2B

| COMPOSITION COMPONENTS | CONTENT OF COMPONENTS (IN MASS %) | | | |
|---|---|---|---|---|
| | VARIANTS | | | |
| | 1 | 2 | 3 | 4 |
| DIAZODINITROPHENOL | 60 | 50 | 60 | 50 |
| MONOPOTASSIUM STYPHNATE | 20 | 20 | 15 | 15 |
| TETRACENE | 5 | 5 | 5 | 5 |
| INERT SENCIBILIZATOR | 15 | 25 | 20 | 30 |

TABLE 3A

| COMPOSITION | WEIGHT CONTENT OF COMPONENTS, % | | |
|---|---|---|---|
| COMPONENTS | VARIANTS | | |
| | 1 | 2 | 3 |
| DIAZODINITROPHENOL | 40 | 65 | 45 |
| POTASSIUM DINITROBENZOFUROXANE | 35 | 10 | 30 |
| TETRACENE | 7 | 4 | 6 |
| INERT SENSIBILIZATOR | 18 | 21 | 19 |

TABLE 3B

| VARI-ANTS | PCC WEIGHT MGR. | $V_{10}$ MED M/S | $P_{MAX}$ MED KG/CM$^2$ | $S_{V10}$ M/C | $S_{PMAX}$ KG/CM$^2$ | $V_{10}$ MED M/S | $P_{MAX}$ MED KG/CM$^2$ | $S_{V10}$ M/C | $S_{PMAX}$ KG/CM$^2$ |
|---|---|---|---|---|---|---|---|---|---|
| 1 | 14 | 312 | 1070 | 2,92 | 35,10 | 312 | 1071 | 2,92 | 35,10 |
| 2 | 14 | 305 | 1030 | 9,48 | 67,34 | 305 | 1033 | 9,48 | 67,34 |
| 3 | 14 | 300 | 1010 | 10,16 | 69,41 | 301 | 1009 | 10,16 | 69,40 |
| 4 | 14 | 288 | 923 | 18,50 | 156,93 | 288 | 923 | 18,52 | 156,87 |
| 1 | 12 | 311 | 1081 | 4,08 | 40,63 | 311 | 1081 | 4,08 | 40,64 |
| 2 | 12 | 300 | 1035 | 8,17 | 44,08 | 300 | 1035 | 8,16 | 44,08 |
| 3 | 12 | 294 | 964 | 8,32 | 51,82 | 294 | 963 | 8,32 | 51,82 |
| 4 | 12 | 250 | 668 | 21,50 | 75,10 | 249 | 669 | 21,48 | 75,10 |

S - STANDARD DEVIATION OF VALUE
C - CALCULATED MEANING OF VALUE

TABLE 4A

| VARIANTS OF PCC | PERCUSSION SENCITIVITY (%) | | | WATER-RESISTANCE % | THERMO-RESISTANCE % |
|---|---|---|---|---|---|
| | WEIGHT 200 GR H=3CM | WEIGHT 200GR H=10CM | WEIGHT 200GR H=14CM | | |
| NEW | 0 | 98 | 100 | 100 | 100 |

TABLE 5A

| VARIANT | PCC WEIGHT, MGRAMMS | TYPE OF POWDER | POWDER CHARGE WEIGHT, G | BULLET VELOCITY MED, $V_{10}$ M/SEC | BULLET VELOCITY DISORDER $D_{V10}$, M/SEC | MAX. POWDER GASES PRESSURE $P_{MAX.MED}$, KG/CM2, | MAX. PRESSURE DISORDER $D_{V10}$, M/SEC | PERCUSSION SENSITIVITY (%) WEIGHT 200 GR | |
|---|---|---|---|---|---|---|---|---|---|
| | | | | | | | | H=3 CM | H=14 CM |
| 1 | 11,5 | P-125 29/91 T | 0,25 | 298 | 18 | 1026 | 127 | 0 | 100 |
| 2 | 10,0 | P-125 29/91 T | 0,22 | 310 | 15 | 1016 | 84 | 0 | 100 |
| 3 | 10,5 | P-125 29/91 T | 0,22 | 308 | 7 | 927 | 44 | 0 | 100 |
| REQUIREMENTS (DRAWING 4-27147) | 20...24 | P-125 | 0,20...0,26 | 290...315 | ≤ 30 | ≤ 1200 | - | 0 | 100 |

TABLE 4B

PYROTECHNICAL PERCUSSION COMBUSTION COMPOSITION FOR SMALL ARMS AMMUNITION PRIMERS

BACKGROUND OF THE INVENTION

This invention relates to ammunition, namely to the percussion pyrotechnical compositions for small arms ammunition primers.

At present before designers of ammunition, as well as in other areas of engineering, there is an ecological problem requiring a significant reduction in the production of products which are harmful to people and nature.

This problem is critical when shooting in closed premises (indoors shooting), in training, and with competitions conducted in shooting galleries.

The current technology is a percussion combustion composition ("PCC") which contains fulminate of mercury ($Hg(ONC)_2$), $KCLO_3$ and $Sb_2S_3$.

A disadvantage of this composition is the high corrosive action of its combustion on the gun barrel.

A common problem with PCC is the presence in their contents of chemical compositions of heavy metals of mercury and lead. These concentrations of heavy metal compounds cause concentrations in the air many times higher than the Maximum Allowable Concentration ("MAC") when used in indoor shooting galleries; these elements and their compounds are formed after PCC burn when shooting indoor.

A number of developments and patents have been developed which provide relatively pure (clean burning) PCC. These techniques use diazodinitrophenol; however, analysis of these compositions has shown that they have a number of essential deficiencies including an unsatisfactory stability of ignition.

As example, the PCC under the patent of U.S. Pat. No. 4,675,059 from 1986 contains (% mass.); diazodinitrophenol—40, tetrazene—10, manganese dioxide—30, glass—20.

This PCC though is far from ideal as it has a low force and a low temperature of burning. This does not allow the PCC to achieve the stable ignition of charges and required ballistic characteristics of small arms centerfire ammunition.

Moreover, manganese dioxide ($MnO_2$) has a much higher specific gravity than other mixture components which results in stratification (separation) of the PCC mixture during storage. Consequently, a reliable and stable primer is not provided.

SUMMARY OF THE INVENTION

In the PCC of the present invention, the task of maintaining ecological safety of its burning products, absence of corrosion action on a barrel, with simultaneous increase of energetic parameters of primer and ballistic characteristics of a shot is achieved.

These objectives of the PCC of this invention are solved through the use of diazodinitrophenol, monopotassium styphnate and tetracene, and non-explosive component—inert inert ceramic stablizer. These materials are ideally used in the following mass content:

| | |
|---|---|
| diazodinitrophenol | 40–60% |
| monopotassium styphnate | 5–40% |
| tetracene | 5–10% |
| inert ceramic stablizer/sensitizer | 15–25% |

An alternative embodiment uses the following mass contents:

| | |
|---|---|
| diazodinitrophenol | 20–70%, |
| potassium azidodinitrophenol | 10–30%, |
| tetrazene | 5–15%, |
| inert ceramic stablizer/sensitizer | 15–35%. |

Some of the distinctive attributes of the PCC of the invention include the introduction of monopotassium styphnate in structure of explosive component of a composition and a new PCC weight structure.

DRAWINGS/TABLES

Tables 1A, 2A, 3A, 4A, and 5A, relate to the diazodinitrophenol/monopotassium syphnate embodiment of the PCC.

Tables 1B, 2B, 3B, and 4B,relate to the diazodinitrophenol/potassium dinitrobenzofuroxane embodiment of the PCC.

In table 1A, the results of ballistic tests of 9-mm ammunition for a Markarov pistol with regular primer KV26, with the PCC of this invention are shown.

In table 2A, the thermodynamic characteristics and structures of products of burning of the PCC of this invention are given.

In table 3A, the structures of four variants (embodiments) of the PCC of this invention with various quantitative weight ratio of components are given.

In table 4A, the experimental data of ballistic tests of the above-stated four variants of PCC in 9-mm pistol ammunition are given with two variants of mass loads of PCC in primer. All charges were from two variants of mass loads of PCC in primer. All charges were from gunpowder P125-29/91 weight 0.24 grams.

In table 5A, the experimental data of the PCC of the preferred embodiment of the invention are given when testing the sensitivity of the percussion, water and thermo-resistance.

Manufacturing the PCC of this invention does not differ from the technology of manufacturing traditional PCC used in regular small arms ammunition and is well known to those of ordinary skill in the art. Further, known technology clearly shows how to produce diazodinitrophenol and monopotassium styphnate.

Further, all components are placed in a dry state in the amalgamator for creation as a homogenous mechanical mix. An appropriate portion of composition is placed in the cap and pressed with specific pressure 800–1700 kilograms/$cm^2$. A seal is then formed using a metal foil. At this point, the cap of metal foil is lacquered by an alkali-spirits varnish or its analogue.

A check of serviceability and the confirmations of higher technical characteristics were conducted using ballistic tests of a 9-mm pistol ammunition with identical powder charge, but with various primers.

The results of tests are given in table 1A. From table 1A it is clear that with the weight of the PCC of this invention, is smaller than traditional PCC, while still maintaining the ballistic characteristics of ammunition requirements for the 9-mm cartridge used in the Makarov pistol.

The increase of the ballistic characteristics and improvement of inflammable ability of the invention's PCC in small arms centerfire ammunition is explained by the higher thermodynamic characteristics of invention's PCC in comparison traditional PCC. This is shown in table 2A, in which the thermodynamic characteristics, and also structures of products of burning of PCC are given.

In table 3A, four variants or embodiments of the invention's PCC are given. Table 4A provides the results of the tests using two levels of weights of PCC in the primer.

The results of test were described by mathematical models (1–4), which adequately to describe processes of a shot and proves the allowable parameters of change of components in new efficient PCC.

$$V_{10}=295+9.3x_1+12x_2+6.3x_3-5x_1x_2-4.5x_1x_2-5x_2x_3+3.5x_1x_2x_3 \quad (1)$$

$$P_{max}=973+58x_1+83x_2+36x_3-37x_1x_2-22x_1x_3-39x_2x_3+25x_1x_2x_3 \quad (2)$$

$$S_{V10}=10.39-4.02x_1-4.32x_2-0.12x_3+1.36x_1x_2+0.29x_1x_3+0.16x_2x_3-0.91x_1x_2x_3 \quad (3)$$

$$S_{Pmax}=67.55-18.31x_1-20.76x_2+14.64x_3+9.39x_1x_2-11.63x_1x_3-10.21x_2x_3+4.43x_1x_2x_3 \quad (4)$$

where xi-coded designation of:
The 1—contents of diazodinitrophenol PCC;
The 2—contents of monopotassium styphnate in PCC;
The 3—weights of PCC in the primer.

The adequacy of the given equations is clear from table 4A, where the variables have the traditional meanings found in basic ballistic characteristics computations. In table 4A, it is clear that the calculated characteristics practically coincide with experimental results. A search of the limits of the invention's PCC, are provided using the requirements of the standard of a cartridge on ballistic characteristics and disorders ($S_{V10}$ and $S_{Pmax}$).
Thus the restrictions were accepted:

$S_{V10}$<7.8 m/sec $S_{Pmax}$<69 kgs.cm, this meets the allowable requirements for variations on the main characteristics of 9-mm pistol cartridge.

The PCC of this invention eliminates the known hazardous emission with each component of the mixture having a specific gravity being equal to or less than 1.7 grams/cubic centimeter.

As a result of the analysis on the limits of the weight contents of components of the invention's PCC provides a reliable centerfire primer which provides a stable ignition of charges and reception of the required ballistic characteristics. The change of weight content of components of the new PCC provides for stable ballistic characteristics.

The composition of this invention provides good combustion ability that gives small disorder of the ballistic characteristics. In table 5A, the results of tests of the new PCC on sensitivity, moisture resistance and thermoresistance (heat and cold) are given. From table 5A, it is clear that new PCC falls within the requirements placed by the industry.

Tables 1B, 2B, 3B, and 4B, relate to the diazodinitrophenol/potassium dinitrobenzofuroxane embodiment of the PCC.

This embodiment introduces potassium dinitrobenzofuroxane into the composition which includes diazodinitrophenol, tetrazeneand an inert inert ceramic stablizer. In this embodiment, the materials are combined in the following mass content:

| | |
|---|---|
| diazodinitrophenol | 40–65% |
| potassium dinitrobenzofuroxane | 10–35% |
| tetracene | 4–7% |
| inert inert ceramic stablizer/sensitizer | 18–21% |

This embodiment of the PCC solves the problem of maintaining the ecological purity of the burning products, removes the corrosive action, increases the energetic parameters of the primer and ballistic characteristics of a shot, provides enhanced stability, and improves safety.

In table 1B, this embodiment's thermodynamic characteristics and structure of burned products is explained.

Table 2B provides the results of ballistic tests using this embodiment when tested using 5.6 mm rimfire sports ammunition.

Table 3B provides three alternative PCC variants of this embodiment.

Table 4B provides data on this primers of this embodiment and their sensitivity to percussion, and their ballistic characteristics in 9 mm. Makarov ammunition.

As with the previously discussed embodiment, the technology used for manufacturing the PCC of this embodiment does not differ from traditional primer composition manufacturing.

Those in the art readily recognize which technology is useful in the production of diazodinitrophenol and potassium dinitrobenzofuroxane.

For production, all of the components are placed in a dry mix into an amalgamator which provides a homogeneous mechanical mix. An appropriate quantity is then placed in the cartridge case or in the primer cap and pressed with specific pressure 800–1700 kg/cm2.

For the production of centerfire primers, to provide protection from external environmental conditions, a metal foil or paper lacquered by an alkali spirits varnish or its analogue is then placed over the primer mixture.

Tests were conducted on this embodiment which provided the results given in table 1B. From table 1B, it is clear that this new PCC does not contain any ecology harmful elements. The force and temperature of burning of this new PCC is higher.

Further tests explain this embodiments more stable results which are given in table 2B. When used in 5.6 mm rimfire sporting cartridges, this embodiment of the PCC meets all standard requirements for the "Olimp" rimfire cartridge.

Further test on of the ammunition in accelerated conditions simulating 10 years of storage have shown, that this embodiment's ballistic characteristics exhibit practically no change.

In the table 3B three variants of this embodiment are given.

In the table 4B, the results of tests using this embodiment in 9-mm Makarov ammunition are given. Table 4B illustrates that the boundaries of weight content meets the requirements of the standards for 9-mm Makarov cartridge with centerfire primer KV26.

It is clear from the foregoing that the present invention creates a highly improved primer with both ecological and reduction of corrosive affects benefits. The present inventin creates a universal composition suitable for both rimfire and centerfire ammunition.

What is claimed is:

1. A percussion primer mixture for use in ammunition wherein each component of said primer mixture has a specific gravity equal to or less than 1.7 grams per cubic centimeter, said primer mixture comprising:

(a) at least 20 percent by weight diazodinitrophenol;

(b) at least 4 percent by weight tetracene; and (c) at least 5 percent by weight an organic salt of potassium selected from the group consisting of monopotassium styphnate and potassium dinitrobenzofuroxane.

2. The primer mixture according to claim 1, having from 20 to 70 percent by weight of said diazodinitrophenol, from 4 to 15 percent by weight of said tetracene, and from 5 to 40 percent by weight of said organic salt of potassium.

3. The primer mixture according to claim 2, wherein said organic salt of potassium is monopotassium styphnate; and said primer mixture has from 40 to 60 percent by weight of said diazodinitrophenol, and from 5 to 10 percent by weight of said tetracene.

4. The primer mixture according to claim 2, wherein said organic salt of potassium is potassium dinitrobenzofuroxane; and said primer mixture has from 40 to 65 percent by weight of said diazodinitrophenol, from 4 to 7 percent by weight of said tetracene, and from 10 to 35 percent by weight of said potassium dinitrobenzofuroxane.

* * * * *